US012733707B2

(12) United States Patent
Bidal et al.

(10) Patent No.: US 12,733,707 B2
(45) Date of Patent: Sep. 15, 2026

(54) GOLF SHOE WITH SUPPORT STRUCTURE

(71) Applicant: Acushnet Company, Fairhaven, MA (US)

(72) Inventors: Jean-Marie Bidal, Marlborough, MA (US); Robert S. Bento, Raynham, MA (US); Keith M. Duffy, Whitman, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/620,499

(22) Filed: Mar. 28, 2024

(65) Prior Publication Data

US 2025/0302143 A1 Oct. 2, 2025

(51) Int. Cl.

| | |
|---|---|
| ***A43B 5/00*** | (2022.01) |
| ***A43B 13/41*** | (2006.01) |
| ***A43B 17/00*** | (2006.01) |
| ***A43B 17/18*** | (2006.01) |

(52) U.S. Cl.

CPC ..... *A43B 5/001* (2013.01); *A43B 17/006* (2013.01); *A43B 17/18* (2013.01); *A43B 13/41* (2013.01)

(58) Field of Classification Search

CPC ..... A43B 5/001; A43B 13/026; A43B 13/41; A43B 13/42; A43B 7/1466; A43B 17/006; A43B 17/18

See application file for complete search history.

(56) References Cited

U.S. PATENT DOCUMENTS 1,907,997 A * 5/1933 Nickerson ..... A43B 7/223 36/76 R
2,142,839 A * 1/1939 Flint ..... A43B 7/143 36/76 R
2,512,350 A * 6/1950 Ludlam ..... A43B 7/1445 36/179
2,534,462 A * 12/1950 Lumbard ..... A43B 13/141 36/76 R
2,872,746 A * 2/1959 Maccarone ..... A43B 13/41 36/76 R
3,794,037 A * 2/1974 Matteson ..... A43B 7/1464 36/156
4,520,522 A * 6/1985 Allard ..... A43B 13/41 12/21
4,580,359 A * 4/1986 Kurrash ..... A43B 5/001 36/107
4,606,139 A * 8/1986 Silver ..... A43B 13/36 36/15
4,727,661 A * 3/1988 Kuhn ..... A43B 17/00 36/43
4,742,625 A * 5/1988 Sydor ..... A43B 17/18 36/3 R
4,760,654 A * 8/1988 Limbach ..... A43B 5/0427 36/43

(Continued)

*Primary Examiner* — Heather Mangine

(57) ABSTRACT

A golf shoe with an upper and a sole assembly connected to the upper. The sole assembly includes a midsole and an outsole. The golf shoe may comprise a footbed disposed within an interior region of the upper; an insole component provided below the footbed; and a support structure that is fixed to at least one of the midsole, the footbed, or the insole component. The support structure may comprise a free-floating component configured to move relative to the sole assembly as the subject executes a golf-related action or movement.

15 Claims, 12 Drawing Sheets

(56) References Cited

U.S. PATENT DOCUMENTS

RE33,648 E * 7/1991 Brown ..... A43B 13/12 36/154
5,394,626 A * 3/1995 Brown ..... A43B 7/144 36/173
5,733,647 A * 3/1998 Moore, III ..... A43B 7/1464 36/43
6,092,311 A * 7/2000 MacNamara ..... A43B 17/18 36/97
6,125,557 A * 10/2000 Brown ..... A43B 7/14 36/144
6,219,942 B1 * 4/2001 Fini ..... A43B 7/28 36/154
6,226,901 B1 * 5/2001 Rosen ..... A43B 7/1468 36/97
6,408,543 B1 * 6/2002 Erickson ..... A43B 7/144 36/28
6,519,874 B1 * 2/2003 Dean ..... A43B 7/1445 36/43
7,254,905 B2 * 8/2007 Dennison ..... A43B 7/18 36/15
7,370,443 B2 * 5/2008 Gibert ..... A43B 3/0052 36/76 R
7,549,239 B2 * 6/2009 Drollinger ..... A43B 3/0042 36/134
8,250,783 B2 * 8/2012 Luthi ..... A43B 7/1463 36/155
8,312,647 B2 * 11/2012 Hofmann ..... A43B 13/141 36/76 R
9,044,066 B2 6/2015 Lafortune
9,320,318 B2 * 4/2016 Nurse ..... A43B 23/22
9,668,537 B2 * 6/2017 Pedersen ..... A43B 7/141
9,877,544 B2 * 1/2018 Yamamoto ..... A43B 17/02
9,968,157 B2 * 5/2018 Wardlaw ..... A43B 1/0009
10,834,996 B2 * 11/2020 James ..... A43B 5/0413
11,297,895 B2 * 4/2022 Bunnell ..... A43B 23/028
2003/0069807 A1 * 4/2003 Lyden ..... A43B 3/128 705/26.5
2003/0200676 A1 * 10/2003 Gross ..... A43B 13/20 36/15
2004/0103561 A1 * 6/2004 Campbell ..... A43B 23/17 36/155
2005/0066544 A1 * 3/2005 Beak ..... A43B 17/18 36/43
2007/0186446 A1 * 8/2007 Lafortune ..... A43B 17/18 36/43
2007/0266598 A1 * 11/2007 Pawlus ..... A43B 13/16 36/76 R
2008/0047164 A1 * 2/2008 Vindriis ..... A43B 7/147 36/43
2008/0092406 A1 * 4/2008 Ludemann ..... A43B 17/18 36/43
2010/0275460 A1 * 11/2010 Ha ..... A43B 7/144 36/145
2010/0275468 A1 * 11/2010 Shelton ..... A43B 7/144 36/43
2012/0030969 A1 * 2/2012 Lim ..... A43B 7/146 36/141
2012/0055047 A1 * 3/2012 Youngs ..... A43B 13/141 36/25 R
2013/0019499 A1 * 1/2013 Hsu ..... A43B 17/006 36/44
2013/0061495 A1 * 3/2013 Lubart ..... A43B 13/20 36/103
2014/0259752 A1 * 9/2014 Feldman ..... A43B 7/1425 36/43
2014/0259785 A1 * 9/2014 Lester ..... A43B 13/187 36/102
2015/0342295 A1 * 12/2015 Moon ..... A43B 7/146 36/43
2016/0007685 A1 * 1/2016 Lin ..... A43B 17/08 36/44
2016/0044992 A1 * 2/2016 Reinhardt ..... A43B 7/144 36/31
2016/0302518 A1 * 10/2016 Amis ..... A43B 17/18
2017/0273398 A1 * 9/2017 Butler ..... A43B 7/141
2017/0354200 A1 * 12/2017 Orand ..... A43B 13/181
2018/0140043 A1 * 5/2018 Farris ..... A43B 3/0036
2018/0140045 A1 * 5/2018 Farris ..... A43B 3/34
2019/0110554 A1 * 4/2019 Bock ..... A43B 7/141
2019/0216172 A1 * 7/2019 De Callatay ..... A43D 67/00
2020/0107612 A1 * 4/2020 Schickling ..... A43B 17/00
2020/0170336 A1 * 6/2020 Lucca ..... A43B 13/12
2020/0178643 A1 * 6/2020 Butler ..... A43B 7/14
2020/0245719 A1 * 8/2020 Gooch ..... A43B 17/16
2020/0352276 A1 * 11/2020 Fromholtz ..... A43B 7/143
2020/0383422 A1 * 12/2020 Bidal ..... A43B 13/41
2022/0087362 A1 * 3/2022 Bardini ..... A43B 13/41
2022/0378145 A1 * 12/2022 Tateno ..... A43B 13/41
2022/0408877 A1 * 12/2022 Healy ..... A43B 7/144
2023/0135720 A1 * 5/2023 Mankau ..... A43B 13/183 36/27
2023/0172313 A1 * 6/2023 Dombrow ..... A43B 13/141 36/43
2024/0130466 A1 * 4/2024 Duffy ..... A43B 13/026
2025/0108541 A1 * 4/2025 Chen ..... B29C 44/1266

* cited by examiner

GOLF SHOE WITH SUPPORT STRUCTURE

BACKGROUND

The sport of golf can involve a variety of actions that a subject (e.g., a golfer) can perform, such as swinging a golf club, walking a golf course, and/or crouching down to line up a putt. The equipment used to play golf can affect how well or how easily a golfer can perform golf-related actions or movements.

Golf shoes are one example of a piece of equipment that can affect a golfer's performance. In some cases, a functional structure may be embedded in or integrated with the sole assembly of the golf shoes to provide various performance benefits that can enhance a golfer's ability to execute one or more golf-related actions or movements.

SUMMARY

Recognized herein are various shortcomings and disadvantages of conventional shoes with functional structures embedded in or integrated with the sole assembly of the shoes. In some cases, conventional shoes may incorporate a structure such as a plate or an insert into the sole assembly to provide additional control, support, and/or stability for golf-related actions or movements. However, the construction of these shoes may involve lamination, over injection, or the application of adhesives/glues to join various components of the shoe together, which can result in a sole assembly that is overly stiff and relatively inflexible. In some cases, the stiffness and inflexibility of the sole assembly can diminish or even negate the fundamental performance benefits that the functional structures were designed or configured to provide.

The present disclosure addresses the abovementioned shortcomings of conventional shoes by providing various embodiments of shoes with functional structures that can be integrated with the sole assembly without compromising the overall flexibility of the shoe. The shoes disclosed herein may be manufactured or assembled to prevent unwanted stiffness in the sole assembly while still allowing the functional structures to provide real performance benefits that can enhance a golfer's ability to execute golf-related actions or movements both on and off the golf course.

In one aspect, the present disclosure provides a golf shoe comprising an upper and a sole assembly connected to the upper. In some embodiments, the sole assembly may comprise a midsole and an outsole.

In some embodiments, the golf shoe may comprise a footbed. In some embodiments, the footbed may be disposed within an interior region of the upper to support a subject's foot when the subject is wearing the golf shoe.

In some embodiments, the golf shoe may comprise an insole component. In some embodiments, the insole component may be configured to extend under or across a lower end or a bottom portion of the upper. In some embodiments, the insole component may be attached to or otherwise fixed or coupled to the lower end or the bottom portion of the upper. In some embodiments, the upper and the insole component may be attached together to form an enclosed or partially enclosed interior region within the upper. In some embodiments, the insole component may be configured to cover the lower end or the bottom portion of the upper to form the enclosed or partially enclosed interior region within the upper. In some embodiments, the insole component may be attached, joined, or coupled to a bottom edge or a bottom end portion of the upper to form the enclosed or partially enclosed interior region within the upper.

In some embodiments, the golf shoe may comprise a support structure fixed to at least one of the midsole, the footbed, or the insole component. In some embodiments, the support structure may comprise a free floating insert configured to move relative to the sole assembly as the subject executes a golf-related action or movement.

In some embodiments, a heel portion of the support structure may be fixed to a heel portion of the midsole, the footbed, or the insole component. In some embodiments, a remaining portion of the support structure may be detached from the midsole, the footbed, or the insole component. In some embodiments, the remaining portion of the support structure may include an area or a surface of the support structure that extends between (i) the heel portion of the support structure and (ii) a forefoot end or a rearfoot end of the support structure. In some embodiments, the remaining portion of the support structure may include an area or a surface of the support structure that extends between (i) the heel portion of the support structure and (ii) a lateral side or a medial side of the support structure.

In some embodiments, the golf shoe may comprise a channel extending through the midsole of the golf shoe. In some embodiments, the support structure may be positioned within the channel extending through the midsole.

In some embodiments, the heel portion of the support structure may be affixed to the heel portion of the midsole using a fastener. In some embodiments, the fastener may be configured to restrict or limit a movement of the heel portion of the support structure relative to the heel portion of the midsole. In some embodiments, the heel portion of the support structure may be secured to the heel portion of the midsole at a single attachment point. In some embodiments, only the heel portion of the support structure may be attached to the midsole. In some embodiments, the remaining portion of the support structure may be detached or decoupled from the midsole so that the remaining portion can move or slide within or through the channel as the subject executes the golf-related action or movement.

In some embodiments, the footbed may comprise a channel, a recess, or a groove formed within and extending along a bottom surface of the footbed. In some embodiments, the support structure may be positionable along or within the channel, recess, or groove.

In some embodiments, the heel portion of the support structure may be affixed to the heel portion of the footbed using a fastener that restricts or limits a movement of the heel portion of the support structure relative to the heel portion of the footbed. In some embodiments, the remaining portion of the support structure may be detached or decoupled from the footbed so that the remaining portion can move within, along, or through the channel, recess, or groove as the subject executes the golf-related action or movement.

In some embodiments, the golf shoe may comprise a foam material provided between the heel region of the footbed and the heel portion of the support structure. In some embodiments, the fastener may be configured to extend through the foam material provided between the heel region of the footbed and the heel portion of the support structure.

In some embodiments, the heel portion of the support structure may be fixed to an upper surface portion of the insole component. In some embodiments, the remaining portion of the support structure may be detached from and movable relative to the upper surface portion of the insole component.

In some embodiments, the heel portion of the support structure may be fixed to a lower surface portion of the insole component. In some embodiments, the remaining portion of the support structure may be detached from and movable relative to the lower surface portion of the insole component.

In some embodiments, the support structure may have a first orientation that provides a first flex characteristic and a second orientation that provides a second flex characteristic. In some embodiments, the first flex characteristic may be different than the second flex characteristic. In some embodiments, the orientation of the support structure may be changed in order to provide a different flex characteristic (e.g., in the same shoe or in a different shoe).

In some embodiments, the support structure may comprise one or more markers that visually indicate a relative movement or a deformation of the support structure during the golf-related action or movement. In some embodiments, the sole assembly may comprise a window and/or a transparent material layer that is optically aligned with the one or more markers.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Non-limiting and non-exhaustive examples and embodiments of the present disclosure are described and schematically illustrated with reference to the following figures.

DETAILED DESCRIPTION

Overview

From a performance standpoint, a golf shoe needs to provide sufficient control, support, and stability without limiting or restricting the flexibility of the shoe. Some conventional golf shoes may utilize a functional structure (e.g., an insert) that is integrated with or embedded in the sole assembly of the shoe, but the overall sole construction may be overly stiff and relatively inflexible when assembled. In some cases, a stiff and inflexible sole construction may diminish or negate the performance benefits that the functional structures are designed to provide.

Figure 1A:
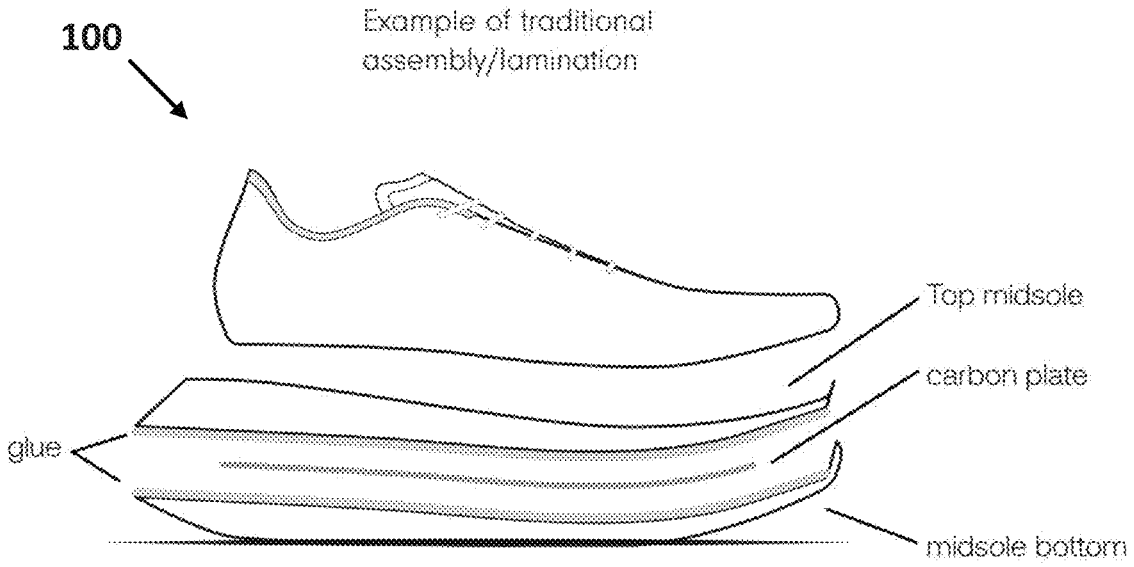
FIG. 1A (prior art)
FIGS. 1A-1C schematically illustrate a conventional shoe that is stiffened when a support structure is integrated with the shoe, in accordance with some embodiments.
Figure 1B:
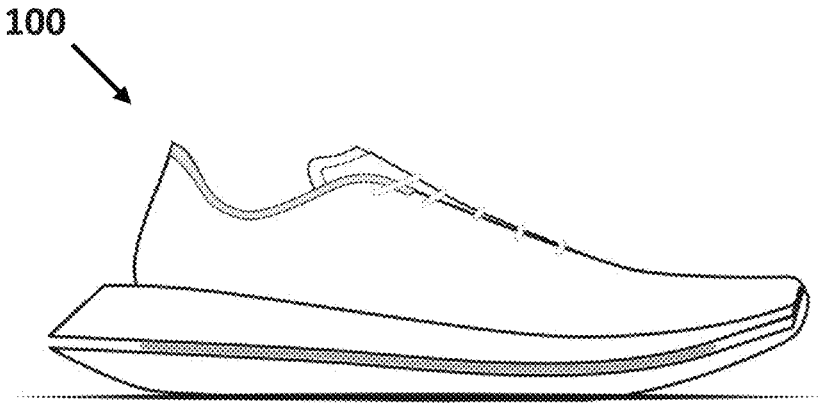
FIG. 1B (prior art)
Figure 1C:
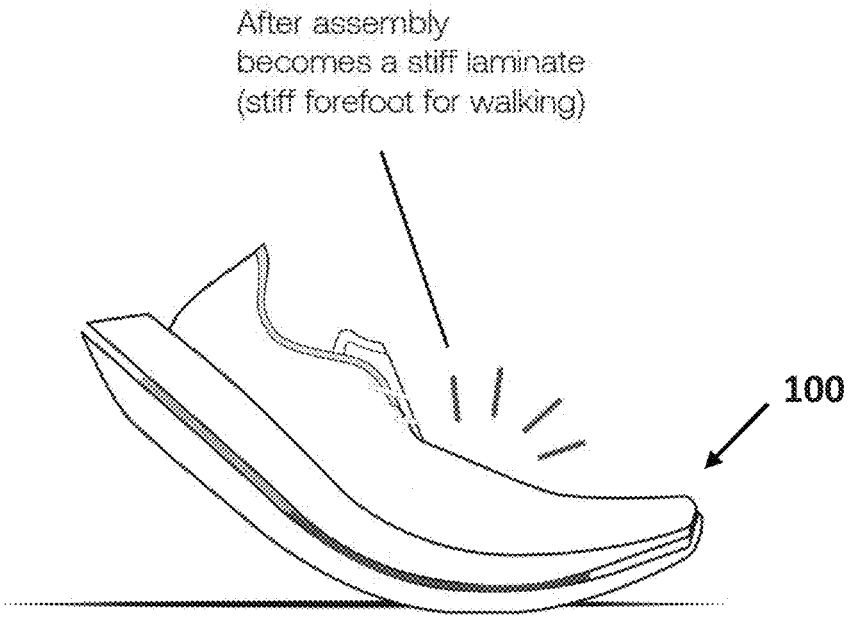
FIG. 1C (prior art)

FIGS. 1A and 1B show an example of a conventional shoe 100 with a laminated assembly. In some embodiments, the laminated assembly may comprise a carbon plate that is positioned between a top midsole portion and a bottom midsole portion. In some embodiments, the carbon plate may be coupled to the top and/or bottom midsole portion(s) using a glue, a primer, or other adhesive material. As shown in FIG. 1C, in some embodiments, the laminated assembly may overly stiffen the shoe, which can negatively impact the comfort and/or the performance characteristics of the shoe.

The present disclosure addresses the shortcomings discussed above by providing various embodiments of golf shoes comprising a functional insert (e.g., a support structure) that can be integrated with or within one or more other components of the shoes without overly stiffening the sole assembly of the shoes. In some embodiments, the golf shoes disclosed herein may utilize a support structure that is free floating relative to one or more other components of the golf shoes.

Golf Shoe

In an aspect, the present disclosure provides a golf shoe. The golf shoe may comprise an article of footwear (e.g., a shoe) that can be worn by a subject to aid in a physical activity such as golf, or any other physical activity involving one or more actions or movements that can be used in the sport of golf. The golf shoe may be worn by a subject. The subject may be, for example, a golf player or a golfer. When worn by the subject, the golf shoe may provide an optimal balance of comfort, control, support, and stability that allows the subject to focus on his or her game in order to maximize performance.

Upper

In some embodiments, the golf shoe may comprise an upper. In some embodiments, the upper may comprise one or more layers or panels of material that are configured to extend around and cover a subject's foot.

In some cases, the upper may comprise, for example, a knit material, a woven material, a non-woven material, a natural leather, a synthetic leather, a natural fabric, a synthetic fabric, or any other type of material formed from a natural or synthetic material. In some cases, the upper may comprise a breathable mesh material. In some cases, the upper may comprise a waterproof or water-resistant material. In some cases, the upper may comprise a porous membrane, a non-porous membrane, or a semi-porous membrane that permits a selective movement or passage of water or moisture through the upper.

In some cases, the upper may comprise a toe box and/or a vamp for covering at least a forefoot region of a subject's foot. In some cases, the upper may comprise a quarter and/or a heel piece for covering and/or supporting one or more side or rear portions of a subject's foot (e.g., the area adjacent to, surrounding, and/or below the Achilles tendon, the posterior of the heel, and/or the talus and calcaneus bones).

In some embodiments, the toe box, the vamp, the quarter, and/or the heel piece may comprise separate pieces or panels of material that are connected or fused to each other mechanically, chemically, thermally, or adhesively. In other embodiments, the upper may comprise a continuous piece or panel of material for the toe box, vamp, quarter, and/or heel piece. The continuous piece or panel of material may not or need not have any seams. In some cases, the continuous piece or panel of material may comprise a plurality of regions having different material properties. In some cases, the continuous piece or panel of material may comprise a plurality of materials having different material properties.

In some embodiments, the upper may comprise an instep region with an opening for inserting a subject's foot into an interior region of the upper. In some cases, the instep region may include a tongue member for covering an upper portion of a subject's foot.

In some embodiments, the golf shoe may comprise one or more laces or cables that can be manipulated to tighten the upper around the subject's foot after the subject inserts his or her foot into the interior region of the upper. In some cases, the one or more laces or cables may be manipulated by the subject manually to secure the upper around the subject's foot. In other cases, the golf shoe may comprise a tightening system that can be used to engage the one or more laces or cables to tighten the upper around the subject's foot. In some cases, the tightening system may include a reel or a spool mechanism for retaining and/or organizing the one or more laces or cables, and a control mechanism (e.g., a dial) for activating and/or deactivating the tightening system. In some cases, the one or more laces or cables may be attached or operatively coupled to the control mechanism and/or the reel or spool mechanism.

Footbed

In some embodiments, the golf shoe may comprise a footbed disposed within the upper. In some embodiments, the footbed may be positioned above a lower end or a bottom portion of the upper. In some embodiments, the footbed may be configured to support a subject's foot when the subject is wearing the golf shoe. In some embodiments, the footbed may be configured to provide a cushioning effect when forces or loads are exerted on the shoe as the subject executes one or more golf-related actions or movements.

Insole

In some embodiments, the golf shoe may comprise an insole component. The insole component may comprise, for example, an insole board. In some cases, the insole component may be attached or otherwise fixed or coupled to a lower end or a bottom portion of the upper. In some cases, the upper and the insole component may be attached together to form an enclosed or partially enclosed interior region within the upper. In some cases, the enclosed or partially enclosed interior region may be volumetrically sized and shaped to accommodate a subject's foot. In some cases, the insole component may be configured to cover the lower end or the bottom portion of the upper to form an enclosed or partially enclosed interior region within the upper for receiving and accommodating a subject's foot. In some cases, the insole component may be attached, joined, or coupled to the upper material to form the enclosed or partially enclosed interior region within the upper.

In some cases, the insole component may comprise a stiff or rigid component configured to provide additional support, stability, balance, or control characteristics to the article of footwear. In some embodiments, the insole component may comprise a board that is positionable between the upper component and the midsole component. In some cases, the board may comprise an insole board, an acrylonitrile butadiene styrene (ABS) board, a thermoplastic polyurethane (TPU) strobel board, or any other type of board that can be used to provide additional support, stability, balance, or control for golf-related actions or movements.

In some cases, the insole component may be configured to extend under the bottom end or lower portion of the upper. In some cases, the insole component may be configured to extend along the bottom end or lower portion of the upper. In some cases, the insole component may be positioned below the footbed provided within the interior region of the upper. In some cases, the insole component may be positioned above the sole assembly of the shoe.

Sole Assembly

In some embodiments, the golf shoe may comprise a sole assembly. In some embodiments, the sole assembly may be connected to the upper. In some embodiments, the sole assembly may be attached or coupled to the insole component of the shoe. In some embodiments, the sole assembly may comprise a midsole and/or an outsole.

Midsole

In some embodiments, the sole assembly may comprise a midsole. In some cases, the midsole may comprise a relatively lightweight material configured to provide cushioning and/or support to the shoe. In some embodiments, the midsole may be made from one or more midsole materials. In some cases, the one or more midsole material may comprise a foam material. In some cases, the foam material may comprise an open cell foam comprising one or more open or partially open cells. In other cases, the foam material may comprise a closed cell foam comprising one or more closed or partially closed cells. In some non-limiting embodiments, the foam material may comprise an elastic foam. The elastic foam may include, for example, ethylene vinyl acetate copolymer (EVA), an elasticized closed-cell foam with rubber-like softness and flexibility. In other non-limiting embodiments, the foam material may comprise a viscous foam. The viscous foam may include, for example, a polyurethane foam or a polyethylene foam. In some alternative embodiments, the foam material may comprise a viscoelastic foam. In some cases, the viscoelastic foam may have the elastic properties of an elastic foam and/or the viscous properties of a viscous foam. In some cases, the viscoelastic foam may comprise a memory foam or a memory foam-like material. In some embodiments, the midsole may comprise a plurality of different foam materials. The plurality of different foam materials may include, for example, foamed ethylene vinyl acetate copolymer (EVA) and/or foamed polyurethane compositions.

Outsole

In some embodiments, the sole assembly may comprise an outsole. In some embodiments, the outsole may be configured to provide traction on various different types of ground surfaces, including on course and off course ground surfaces.

In some embodiments, the outsole may comprise an outsole material. In some cases, the outsole material may be configured to grip a ground surface underneath the shoe (e.g., during a golf-related action or movement). In some embodiments, the outsole material may comprise a plastic material, a thermoplastic material (e.g., thermoplastic polyurethane), or a thermoset plastic material. In some embodiments, the outsole material may include a rubber material or a thermoplastic rubber material, such as polybutadiene, polyisoprene, ethylene-propylene rubber ("EPR"), ethylene-propylene-diene ("EPDM") rubber, and/or styrene-butadiene rubber. In some non-limiting embodiments, the outsole material may include a combination or a blend of thermoplastic polyurethane (TPU) and rubber.

In some embodiments, the outsole may comprise one or more traction elements configured to enhance shoe traction, grip, and stability on a plurality of different surface types. In some embodiments, the one or more traction elements may be configured to frictionally engage the ground surface under the shoe. In some embodiments, the one or more traction elements may be configured to mechanically interlock with the ground surface under the shoe.

In some embodiments, the plurality of traction elements may comprise one or more spikes (e.g., hard spikes or soft spikes). In some embodiments, the plurality of traction elements may comprise one or more cleats. In some embodiments, the one or more spikes or cleats may comprise one or more arms, legs, extensions, or high aspect ratio structures configured to at least partially penetrate or otherwise physically interface with or contact the ground surface.

In some embodiments, the plurality of traction elements may not or need not comprise any spikes. For example, in some cases, the traction elements may comprise a spikeless feature that is configured to reduce a lateral or translational movement of the shoe relative to a ground surface when a force is exerted on the shoe. In some embodiments, the spikeless feature may comprise a protrusion, a depression, or a textured surface or material provided on or integrally formed with the outsole.

In some non-limiting embodiments, the one or more traction elements may comprise one or more replaceable traction elements that are removable or detachable from the outsole. In other non-limiting embodiments, the one or more traction elements may comprise one or more integrated traction elements that are integrally formed with the outsole material. In some embodiments, the one or more integrated traction elements may not or need not be removable or detachable from the outsole.

Foot Subregions

The shoe components described herein may comprise a forefoot region, a midfoot region, and a rearfoot region. Each of the forefoot region, the midfoot region, and the rearfoot region may correspond to a respective forefoot, midfoot, and rearfoot portion of a subject's foot. In general, the anatomy of a human foot can be divided into three bony regions. The rearfoot region of the foot may include the ankle (talus) and heel (calcaneus) bones. The midfoot region of the foot may include the cuboid, cuneiform, and navicular bones that form the longitudinal arch of the foot. The forefoot region of the foot may include the metatarsals and the toes. The shoe, and accordingly, the components of the shoe, may comprise a rearfoot region corresponding to the rearfoot and/or heel area of the foot, a midfoot region that corresponds to the midfoot area of the foot, and a forefoot region corresponding to the forefoot and/or toe area of the foot. In some cases, the rearfoot region and the heel area may be positioned next to a posterior end of the shoe. In some cases, the forefoot region and the toe area may be positioned next to an anterior end of the shoe.

In some cases, the forefoot, midfoot, and rearfoot regions may extend between a posterior end and an anterior end of the shoe. In some cases, the forefoot, midfoot, and rearfoot regions may extend laterally across a width of the shoe. In some cases, the forefoot, midfoot, and rearfoot regions may extend between a medial side and a lateral side of the shoe.

The shoe components described herein may have a medial side and a lateral side that are opposite one another. The medial side may generally correspond to an inside area of a subject's foot and may face towards the subject's other foot. The lateral side may generally correspond to an outside area of the subject's foot and may face away from the wearer's other foot. In some cases, the lateral side and the medial side may extend through the rearfoot area, the midfoot area, and the forefoot area of the shoe. In some cases, the lateral side and the medial side may extend between an anterior end and a posterior end of the shoe. In some cases, the medial side and the lateral side may extend along the periphery or perimeter of the shoe between the anterior and posterior ends of the shoe.

In some cases, the medial and lateral sides of the shoe may be divided by a central axis. In some cases, the central axis may extend between the rearfoot region of the shoe and the forefoot region of the shoe. In some cases, the medial and lateral sides of the shoe may be divided along one or more curved axes that deviate from the central axis.

Free Floating Insert

In some embodiments, the golf shoes disclosed herein may comprise a functional insert that is free floating relative to one or more other components of the golf shoes. In some embodiments, the functional insert may comprise a free floating insert that can be attached or coupled to one or more other components of the shoes without overly stiffening the shoes.

In some embodiments, the free floating insert may comprise a support structure that is fixed to at least one of the midsole, the footbed, or the insole component of the shoe. In some embodiments, the support structure may be fixed to the midsole, the footbed, or the insole component of the shoe at a single point or location (e.g., in or near the rearfoot or heel region of the shoe). In other embodiments, the support structure may be fixed to the midsole, the footbed, or the insole component of the shoe at multiple points or locations that are co-located (e.g., in or near the rearfoot or heel region of the shoe).

In some embodiments, a heel portion of the support structure may be fixed to a heel portion of the midsole, the footbed, or the insole component. In some embodiments, a remaining portion of the support structure may be detached from the midsole, the footbed, or the insole component. In some cases, the remaining portion of the support structure may include an area or a surface of the support structure that extends between (i) the heel portion of the support structure and (ii) a forefoot end or a rearfoot end of the support structure. In some cases, the remaining portion of the support structure may include an area or a surface of the support structure that extends between (i) the heel portion of the support structure and (ii) a lateral side or a medial side of the support structure. In some cases, the remaining portion of the support structure may include one or more areas of the support structure that are in or near the heel region but positioned away from the point of attachment between the support structure and the midsole, footbed, or insole. In some cases, the remaining portion of the support structure may include one or more areas of the support structure that are outside of the heel region.

In some cases, a forefoot portion and a midfoot portion of the support structure may be detached from the midsole, the footbed, or the insole component. In some cases, the portions of the support structure surrounding the point of attachment between the support structure and the midsole, footbed, or insole may also be detached from the midsole, the footbed, or the insole component. In some cases, the portions of the support structure surrounding the point of attachment may include one or more areas or sections of the support structure that are positioned between (i) the point of attachment in the heel region and (ii) the posterior end of the shoe. In some cases, the portions of the support structure surrounding the point of attachment may include one or more areas or sections of the support structure that are positioned between (i) the point of attachment in the heel region and (ii) the medial or lateral side(s) of the rearfoot region of the shoe. In some cases, the portions of the support structure surrounding the point of attachment may include one or more areas or sections of the support structure that are positioned between (i) the point of attachment in the heel region and (ii) the anterior end of the shoe.

In some embodiments, the support structure may be configured as a free floating insert that is configured to move as the subject executes a golf-related action or movement. In some embodiments, the free floating insert may be configured to move relative to one or more other components of the golf shoe. In some embodiments, the free floating insert may be configured to move through one or more other components of the golf shoe. In some embodiments, the free floating insert may be configured to translate or slide across or along an inner or outer surface portion of the one or more other components of the golf shoe. In some embodiments, the free floating insert may be configured to rotate or pivot relative to one or more other components of the golf shoe. In some embodiments, the free floating insert may be configured to flex, stretch, twist, turn, bend, or fold independently of the other components, materials, or structural features surrounding the free floating insert.

Example #1

Figure 2A:
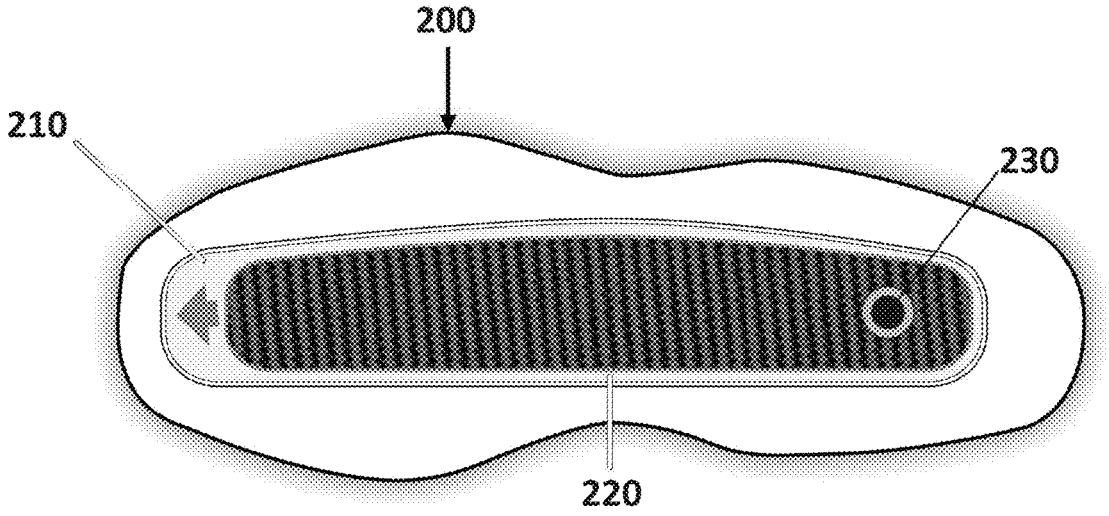
FIGS. 2A and 2B schematically illustrate an example of a free floating support structure that can be integrated with the shoe without overly stiffening the shoe, in accordance with some embodiments.
Figure 2B:
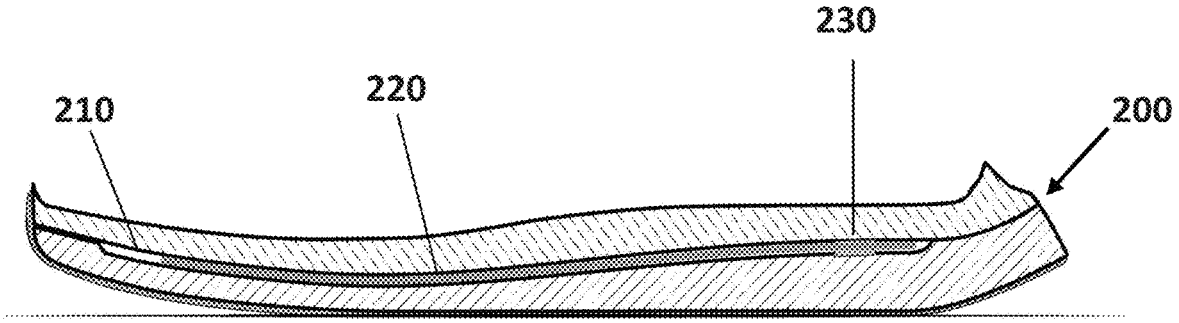

Referring now to FIGS. 2A and 2B, in some embodiments, the golf shoe may comprise a support structure 220 attached to a midsole 200 of the golf shoe. In some embodiments, the midsole 200 may have a channel 210 extending through a portion of the midsole 200. In some embodiments, the support structure 220 may be positioned in or within the channel 210. In some embodiments, the support structure 220 may be positioned entirely within the channel 210.

In some embodiments, a heel portion of the support structure 220 may be affixed to a heel portion of the midsole using a fastener 230. In some cases, the fastener 230 may be configured to restrict or limit a movement of the heel portion of the support structure relative to the heel portion of the midsole. In some cases, the fastener 230 may comprise, for example, a clip, a rivet, a snap fit mechanism, or any other type of mechanical fastener.

In some non-limiting embodiments, the fastener 230 may comprise a circular cross-sectional shape to allow the support structure 220 to rotate relative to the midsole 200. In other more preferred embodiments, the fastener 230 may comprise a non-circular cross-sectional shape to limit or restrict a rotation of the support structure 220 relative to the midsole 200. In some cases, the non-circular cross-sectional shape may include an oval or an ellipse. In other cases, the non-circular cross-sectional shape may include any regular or irregular polygon with three or more sides.

In some embodiments, the heel portion of the support structure 220 may be secured to the heel portion of the midsole using the fastener 230. In some embodiments, the fastener 230 may serve as the only point of attachment between the support structure 220 and the midsole.

In some embodiments, only the heel portion of the support structure 220 may be attached to the heel portion of the midsole 200. In some embodiments, a remaining portion of the support structure 220 may be detached or decoupled from the midsole 200 so that the remaining portion can move or slide within or through the channel 210 in the midsole 200 as the subject executes a golf-related action or movement.

Figure 3:
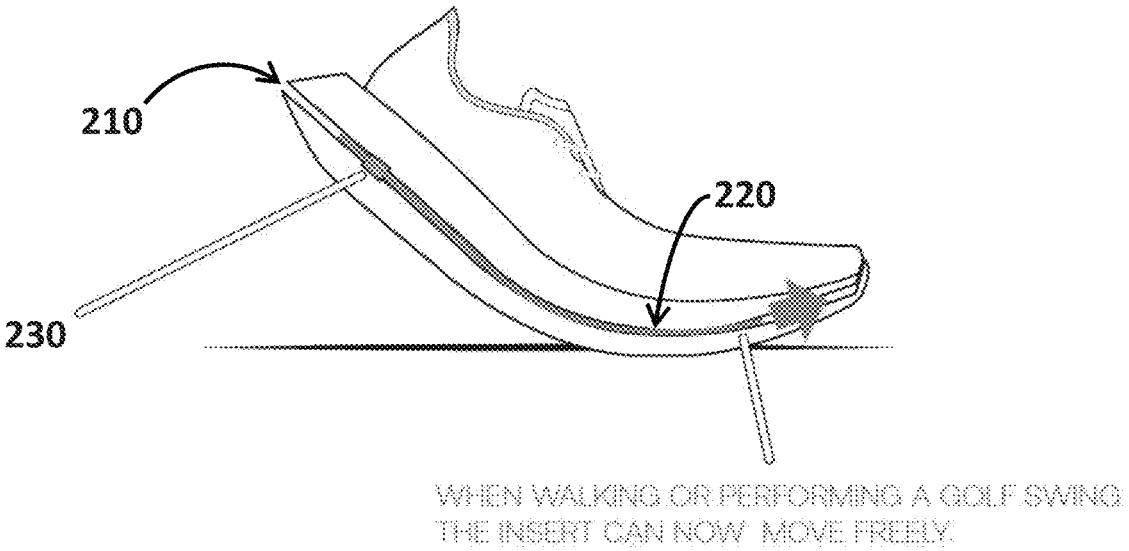
FIG. 3 schematically illustrates an ability of the free floating support structure to move freely relative to other components of the shoe, in accordance with some embodiments.

FIG. 3 shows a cross-sectional side view of a golf shoe with a free floating support structure. In some embodiments, the free floating support structure may comprise a support structure 220 that is positioned or positionable within a channel 210 extending through the midsole of the shoe. In some embodiments, the heel portion of the support structure 220 may be fixed to a heel portion of the midsole using a fastener 230, and a remaining portion of the support structure 220 may be detached or decoupled from the midsole.

In some embodiments, when a subject wearing the golf shoe performs a golf-related action or movement, the support structure 220 may be configured to move freely within or through the channel 210 in the midsole. Because the remaining portion of the support structure 220 is detached or decoupled from the midsole, the sole construction may be more flexible compared to other conventional shoes with inserts that are fully laminated to the other surrounding components of the shoe.

Example #2

In some embodiments, the support structure may be fixed to a footbed of the shoe instead of the midsole of the shoe. In some embodiments, the heel portion of the support structure may be affixed to the heel region of the footbed. In some embodiments, the support structure may be free floating underneath the footbed.

Figure 4A:
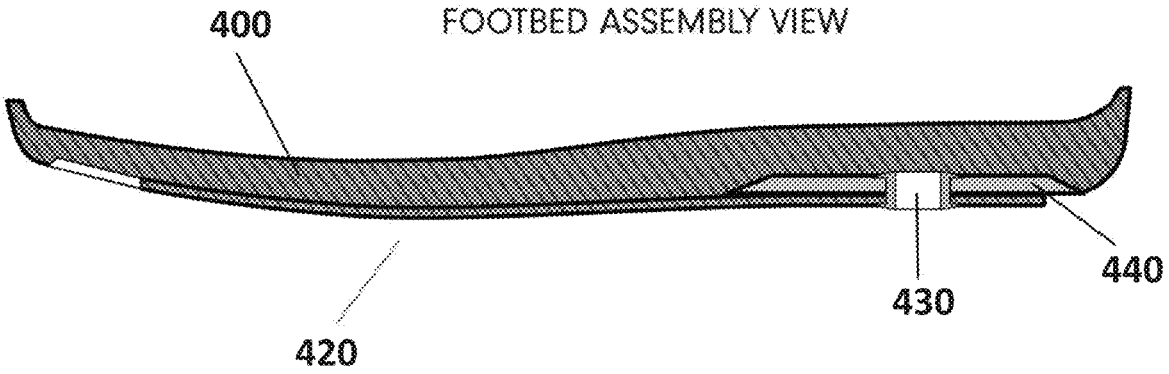
FIGS. 4A-4C schematically illustrate an example of a free floating support structure that can be integrated with a footbed of a shoe, in accordance with some embodiments.
Figure 4B:
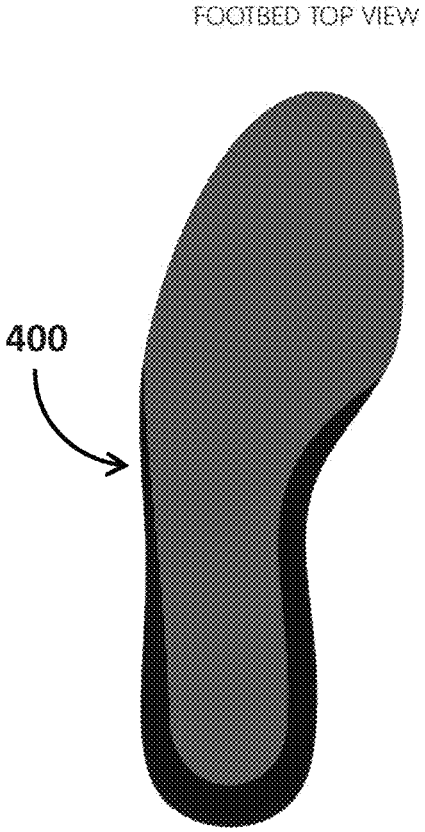
Figure 4C:
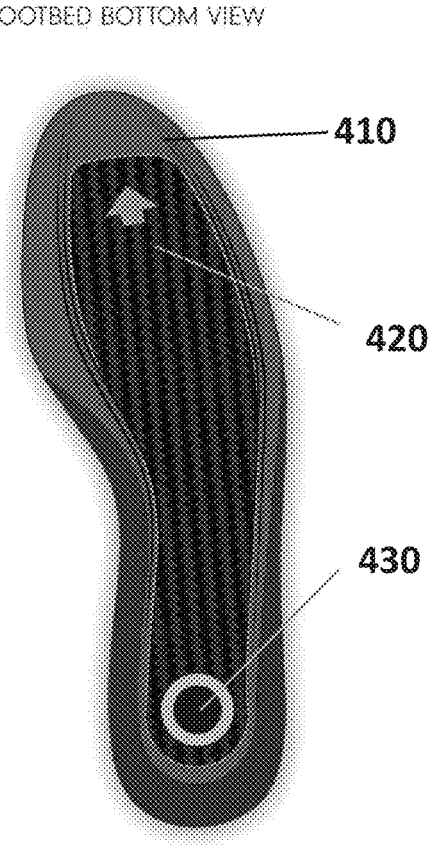

FIGS. 4A-4C show a footbed 400 with a support structure 420 affixed to a heel portion of the footbed 400. In some embodiments, the heel portion of the support structure 420 may be attached to the heel region of the footbed 400 using a fastener 430. In some embodiments, the support structure 420 may be configured to extend underneath the footbed 400. In some embodiments, the support structure 420 may be configured to extend across or along a bottom surface of the footbed 400.

In some embodiments, the bottom surface of the footbed 400 may comprise a channel, a groove, or a recess 410 formed within the bottom surface of the footbed 400. In some embodiments, the bottom surface of the footbed 400 may comprise a channel, a groove, or a recess 410 extending along or across the bottom surface of the footbed 400. In some embodiments, the support structure 420 may be positionable along or within the channel, groove, or recess 410.

In some embodiments, a select portion of the support structure 420 may be affixed to a heel portion of the footbed 400 using a fastener 430. In some embodiments, the select portion may include a heel portion of the support structure 420. In some embodiments, the fastener may be configured to restrict or limit a movement of the heel portion of the support structure 420 relative to the heel portion of the footbed 400. In some cases, the fastener 430 may comprise, for example, a clip, a rivet, a snap fit mechanism, or any other type of mechanical fastener.

In some embodiments, only the heel portion of the support structure may be attached to the footbed. In some embodiments, a remaining portion of the support structure may be detached or decoupled from the footbed so that the support structure can move within, along, across, or through the channel, recess, or groove as the subject executes a golf-related action or movement.

Foam Component

As shown in FIG. 4A, in some embodiments, a foam component 440 may be provided between the footbed 400 and the support structure 420. In some embodiments, the foam component 440 may be integrally formed with the footbed 400. In some embodiments, the foam component 440 may form at least a portion of the footbed 400. In some embodiments, the foam component 440 may comprise a die cut sheet foam patch that is attached or secured to the footbed 400. In some embodiments, the fastener 430 used to secure the heel portion of the support structure 420 to the heel region of the footbed 400 may be configured to extend through the foam component 440 provided between the footbed 400 and the support structure 420.

Example #3

Figure 5A:
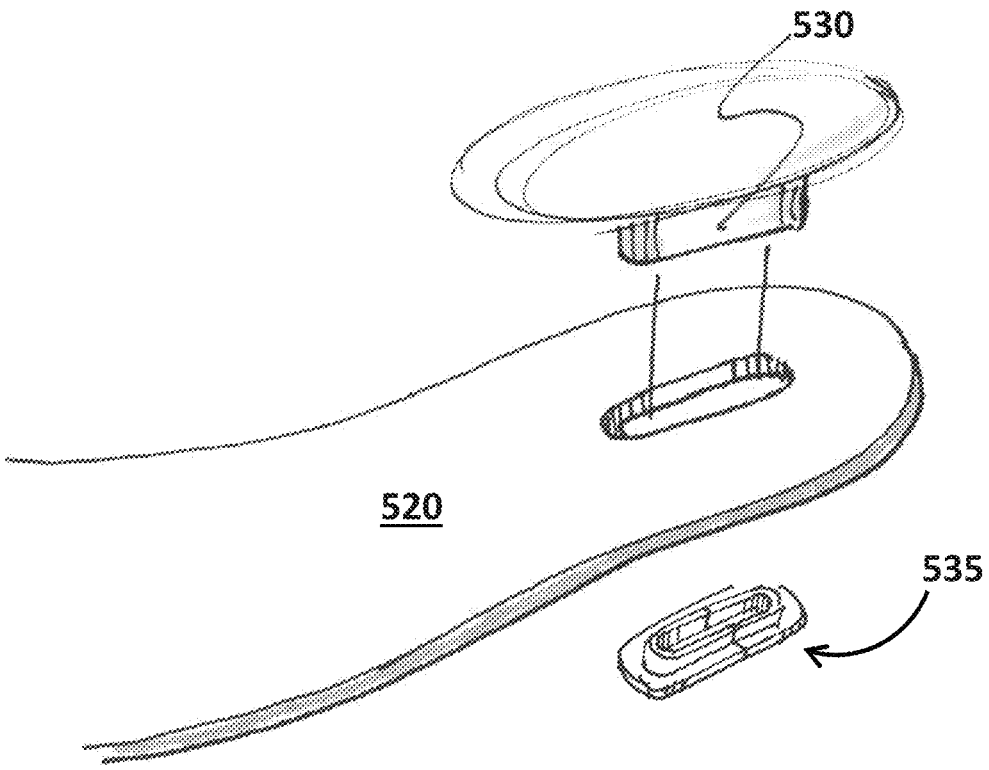
FIGS. 5A and 5B schematically illustrate another example of a free floating support structure that can be integrated with a footbed of a shoe, in accordance with some embodiments.
Figure 5B:
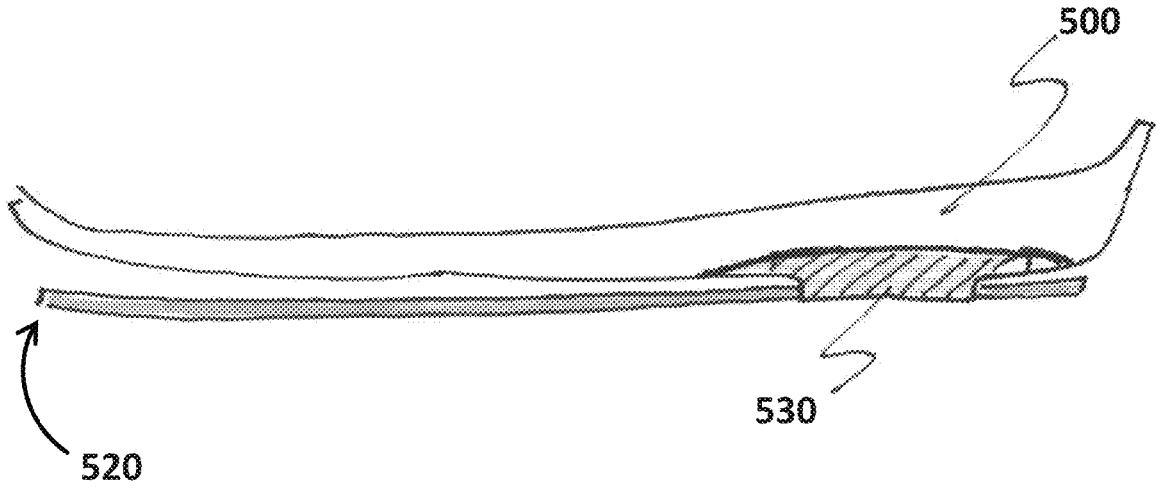

Referring to FIGS. 5A and 5B, in some embodiments, the support structure 520 may be fixed to a footbed 500 of the shoe using a connector piece 530. In some embodiments, the connector piece 530 may comprise a relatively hard foam material. In some embodiments, the upper portion of the connector piece 530 may be attached to, integrated with, or integrally formed with the footbed 500, which may comprise a relatively soft foam material.

In some embodiments, the bottom portion of the connector piece 530 may comprise a protrusion that can engage with the support structure 520. In some embodiments, the protrusion may be configured to extend through an opening or an aperture formed within the support structure 520. In some embodiments, the bottom end of the connector piece 530 may be attached or coupled to an insole component or a midsole of the shoe. In some embodiments, the bottom end of the connector piece 530 may engage a complementary piece 535 in order to fix a position and/or an orientation of a heel portion of the support structure 520 relative to a heel portion of the footbed 500. In some embodiments, the protrusion may have a non-circular cross-sectional shape to limit or restrict a rotation of the support structure 520 relative to the footbed 500.

Example #4

Figure 6A:
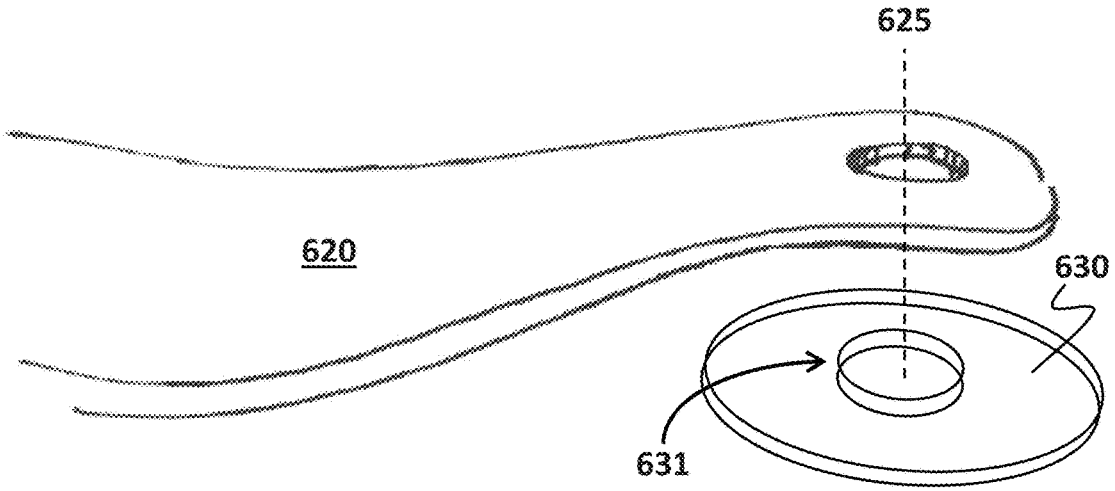
FIGS. 6A and 6B schematically illustrate another example of a free floating support structure that can be integrated with a footbed of a shoe, in accordance with some embodiments.
Figure 6B:
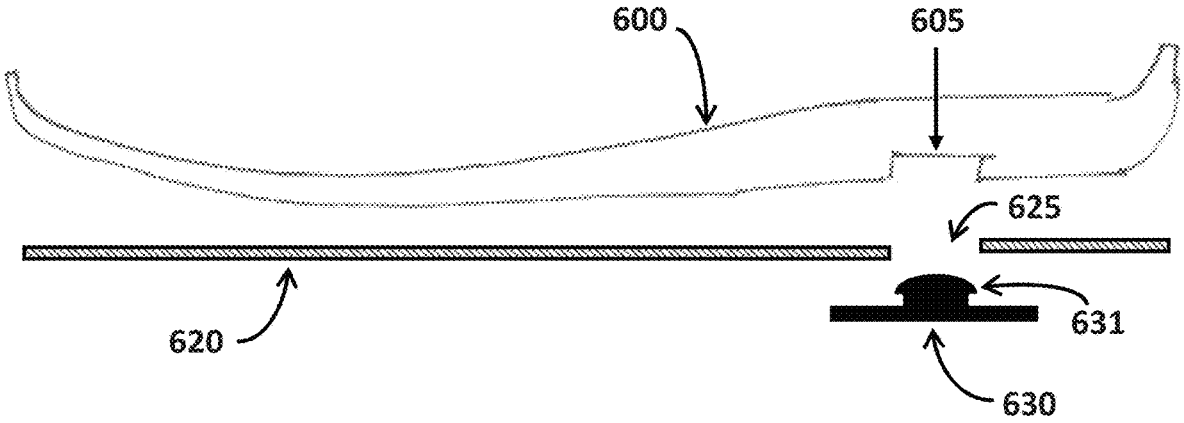

Referring to FIGS. 6A and 6B, in some embodiments, the support structure 620 may be attached or coupled to a footbed 600 of the shoe using a connector piece 630. In some embodiments, the base of the connector piece 630 may be positioned underneath or below the support structure 620. In some embodiments, the upper surface of the connector piece 630 may comprise a protrusion 631 configured to engage with the support structure 620. In some cases, the protrusion 631 may be configured to extend through a portion of the support structure 620. In some cases, the protrusion 631 may be configured to extend through an aperture or window 625 provided in the heel region of the support structure 620.

In some cases, the protrusion 631 may be configured to extend through the aperture or window 625 so that the distal end of the protrusion 631 is positionable within a cavity or a recess 605 formed along a bottom surface portion of the footbed 600. In some cases, the cavity or recess 605 may be positioned in the heel region of the footbed 600. When the distal end of the protrusion 631 is positioned within the cavity or recess 605, the connector piece 630 may be configured to secure a position and/or an orientation of the heel portion of the support structure 620 relative to the heel portion of the footbed 600.

Example #5

Figure 7:
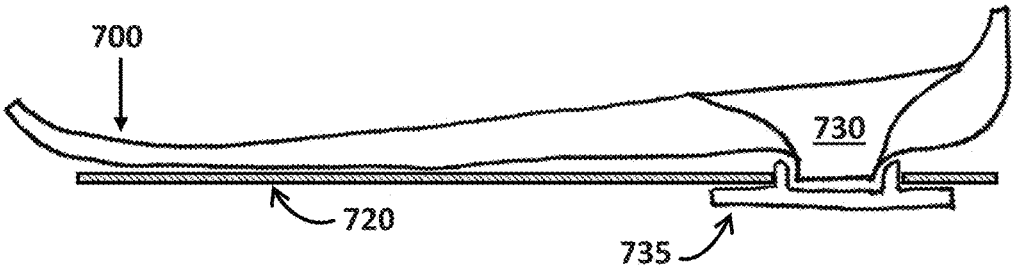
FIGS. 7-9 schematically illustrate other examples of a free floating support structure that can be integrated with a footbed of a shoe, in accordance with some embodiments.

Referring now to FIG. 7, in some embodiments, the support structure 720 may be attached to the footbed 700 of the shoe using a connector piece 730. In some embodiments, the connector piece 730 may be integrated with or integrally formed with the heel portion of the footbed 700. In some embodiments, the connector piece 730 may form a part of the heel portion of the footbed 700. In some cases, the connector piece 730 may comprise a same or similar material as the footbed 700. In other cases, the connector piece 730 and the footbed 700 may comprise different materials.

In some embodiments, the connector piece 730 may be configured to engage with a complementary piece 735 positioned under the support structure 720 in order to fix a position and/or an orientation of the heel portion of the support structure 720 relative to the heel portion of the footbed 700. In some embodiments, the complementary piece 735 may be configured to engage with the connector piece 730 to fix the position and/or orientation of the heel portion of the support structure 720 relative to the heel portion of the footbed 700.

In some embodiments, the support structure 720 may comprise an aperture or a hole provided in the heel region of the support structure. In some cases, a lower portion of the connector piece 730 and/or an upper portion of the complementary piece 735 may be configured to extend through the aperture or hole. In some cases, the attachment interface or the area of contact between the connector piece 730 and the complementary piece 735 may be positioned above or below the aperture or hole. In other cases, the attachment interface or the area of contact between the connector piece 730 and the complementary piece 735 may be aligned with the aperture or hole.

Example #6

Figure 8:
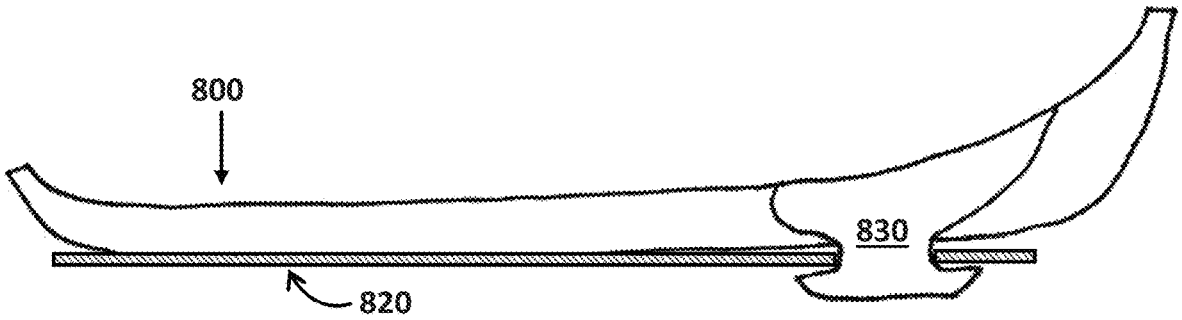

As shown in FIG. 8, in some embodiments, the support structure 820 may be attached to the footbed 800 using a connector piece 830. In some cases, the connector piece 830 may be a unitary structure that is integrally formed with the footbed 800. In some embodiments, the connector piece 830 may form a part of the heel portion of the footbed 800. In some embodiments, the connector piece 830 may be configured to fix a position and/or an orientation of the heel portion of the support structure 820 relative to the heel portion of the footbed 800.

In some cases, a portion of the connector piece 830 may be configured to extend through a window or an opening in the heel region of the support structure 820. In some cases, the lower end of the connector piece 830 may be positioned below the window or opening. In some cases, the lower end of the connector piece 830 may have a lateral dimension that is greater than the size of the window or opening in the support structure 820, in order to keep the heel portion of the support structure 820 fixed to the heel region of the footbed 800.

Example #7

Figure 9:
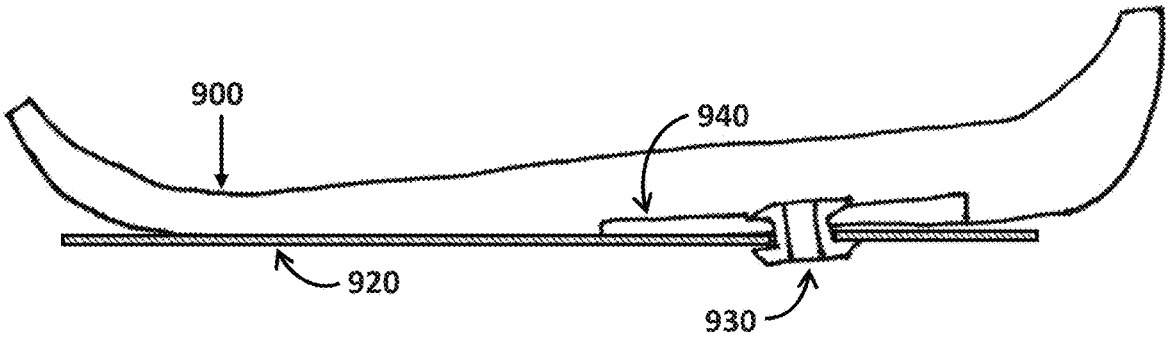

As shown in FIG. 9, in some embodiments, the heel portion of the support structure 920 may be attached to the heel portion of the footbed 900 using a fastener 930. The fastener 930 may comprise any of the fasteners described elsewhere herein. In some embodiments, the fastener 930 may be configured to fix a position and/or an orientation of the heel portion of the support structure 920 relative to the heel portion of the footbed 900.

In some embodiments, an additional layer of material 940 may be provided between the footbed 900 and the support structure 920. In some embodiments, the additional layer of material 940 may be positioned in or along a heel region of the footbed. In some embodiments, the additional layer of material 940 may comprise a die cut sheet foam patch that is attached or coupled to the bottom of the footbed 900. In some embodiments, the additional layer of material 940 may comprise a foam layer that is integrally formed with footbed 900. In some embodiments, the fastener 930 securing the support structure 920 to the footbed 900 may be configured to extend through the additional layer of material 940 provided between the footbed 900 and the support structure 920.

Example #8

Figure 10A:
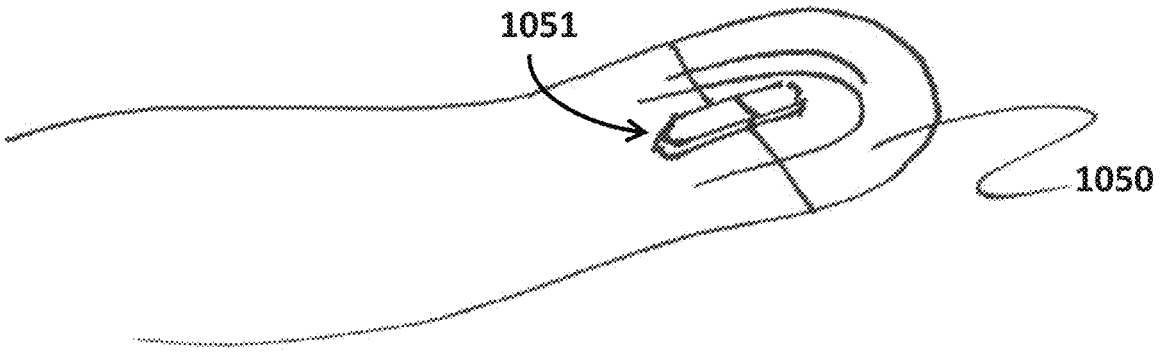
FIGS. 10A and 10B schematically illustrate an example of a free floating support structure that can be integrated with an insole component of a shoe, in accordance with some embodiments.
Figure 10B:
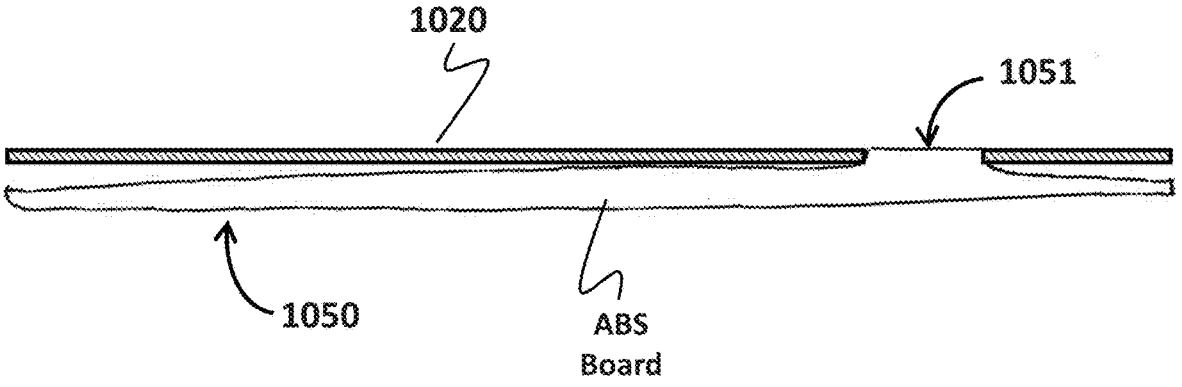

Referring now to FIGS. 10A and 10B, in some embodiments, the support structure 1020 may be attached to an insole component 1050 of the shoe instead of the midsole or the footbed of the shoe. In some embodiments, the support structure 1020 may be attached to an upper portion of the insole component 1050 of the shoe.

In some embodiments, a heel portion of the support structure 1020 may be fixed to an upper portion of the insole component 1050. In some embodiments, the upper portion of the insole component 1050 may comprise a protrusion 1051 extending upwards from the upper surface of the insole component 1050. In some embodiments, the protrusion 1051 may be configured to engage with the heel portion of the support structure 1020 in order to fix a position and/or an orientation of the heel portion of the support structure 1020 relative to the heel portion of the insole component 1050. In some embodiments, the protrusion 1051 may be configured to extend through an aperture or a window in the heel portion of the support structure 1020 in order to fix the position and/or the orientation of the heel portion of the support structure 1020 relative to the heel portion of the insole component 1050. In some embodiments, the protrusion 1051 may have a non-circular cross-sectional shape to limit or restrict a rotation of the support structure 1020 relative to the insole component 1050 of the shoe.

In some embodiments, a remaining portion of the support structure 1020 may be detached from and movable relative to the upper surface portion of the insole component. In some embodiments, the remaining portion of the support structure 1020 may include any portion of the support structure 1020 that is not directly engaged with the protrusion 1051. In some embodiments, the remaining portion of the support structure 1020 may include any portion of the support structure 1020 that is not in direct contact with the protrusion 1051 extending upwards from the upper surface of the insole component 1050.

Figure 11:
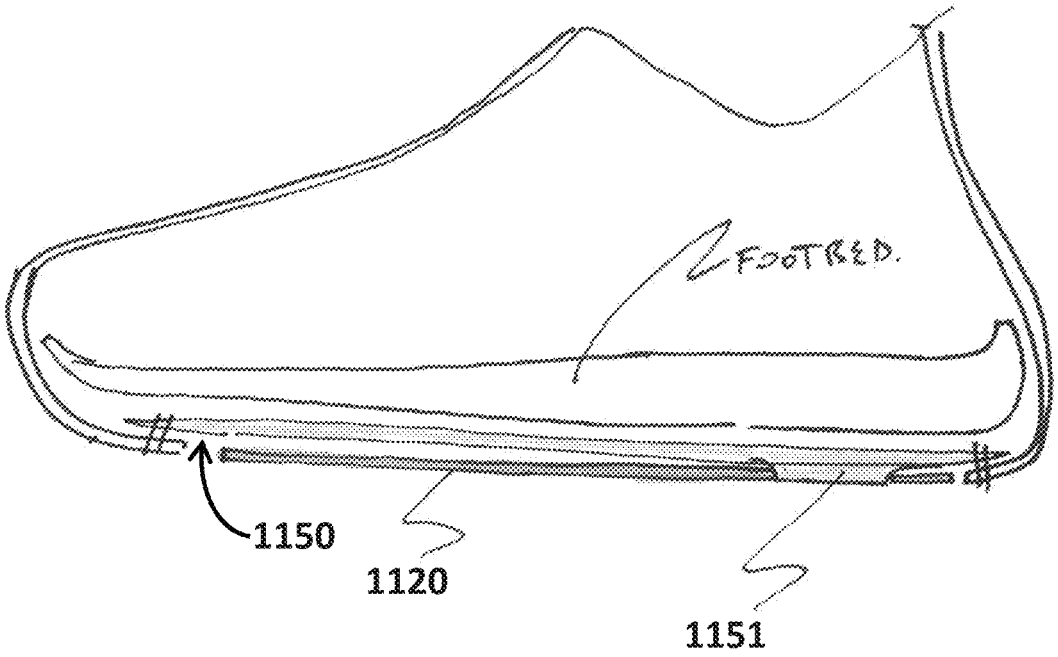
FIG. 11 schematically illustrates another example of a free floating support structure that can be integrated with an insole component of a shoe, in accordance with some embodiments.

Referring to FIG. 11, in some embodiments, the support structure 1120 may be attached to an insole component 1150 of the shoe. In some cases, the support structure 1120 may be attached to a lower portion of the insole component 1150 of the shoe.

In some embodiments, a heel portion of the support structure 1120 may be fixed to a lower surface portion of the insole component 1150. In some embodiments, the lower surface portion of the insole component 1150 may comprise a protrusion 1151 extending downwards from the lower surface of the insole component 1150. In some embodiments, the protrusion 1151 may be configured to engage with the heel portion of the support structure 1120 in order to fix a position and/or an orientation of the heel portion of the support structure 1120 relative to the heel portion of the insole component 1150. In some embodiments, the protrusion 1151 may be configured to extend through an aperture or a window in the heel portion of the support structure 1120 in order to fix the position and/or the orientation of the heel portion of the support structure 1120 relative to the heel portion of the insole component 1150.

In some embodiments, a remaining portion of the support structure 1120 may be detached from and movable relative to the lower surface portion of the insole component 1150. In some embodiments, the remaining portion of the support structure 1120 may include any portion of the support structure 1120 that is not directly engaged with the protrusion 1151. In some embodiments, the remaining portion of the support structure 1120 may include any portion of the support structure 1120 that is not in direct contact with the protrusion 1151 extending downwards from the lower surface of the insole component 1150.

Low Friction Coating

In some embodiments, one or more low friction materials may be provided or applied to facilitate a movement of the support structure relative to the other surrounding components of the shoe. In some cases, the one or more low friction materials may be provided between (i) the support structure and (ii) the midsole, the footbed, or the insole component of the shoe. In some cases, the one or more low friction materials may be coated on or applied to a surface of the support structure. In some cases, the one or more low friction materials may be coated on or applied to a surface of the midsole, the footbed, and/or the insole component of the shoe.

Transparent Layer

Figure 12:
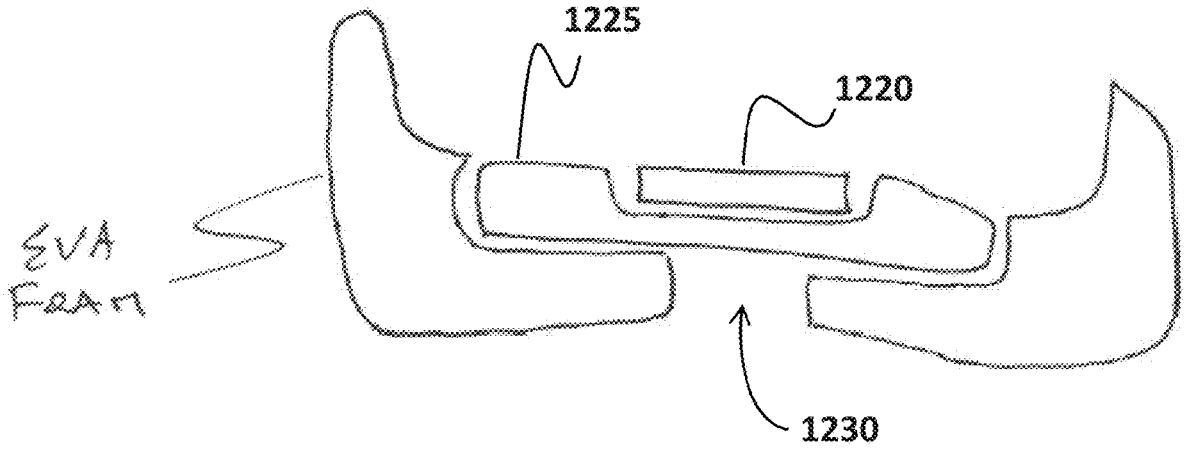
FIG. 12 schematically illustrates a sole assembly with a transparent window that reveals or exposes a free floating support structure within the shoe, in accordance with some embodiments.

Referring now to FIG. 12, in some embodiments, the golf shoes described herein may comprise a support structure 1220 that is fixed to another component of the shoe at a single attachment point. In some cases, the single attachment point may be located in or near a heel portion of the midsole, the footbed, or the insole component of the shoe.

In some embodiments, the golf shoes of the present disclosure may include a transparent layer 1225 that is positioned between the support structure 1220 and the midsole of the shoe. In some cases, the midsole may comprise a window or opening 1230 that is optically aligned with the transparent layer 1225 and the support structure 1220. In some cases, the transparent layer 1225 and the window or opening 1230 may be configured to reveal or expose the support structure 1220 within the shoe. In some cases, the transparent layer 1225 and the window or opening 1230 may be configured to show the movement of the support structure 1220 or a physical deformation of the support structure 1220 in response to one or more forces exerted on the shoe during a golf-related action or movement.

Visual Markers

In some embodiments, the support structure may comprise one or more markers that visually indicate a movement or a deformation of the support structure during a golf-related action or movement. In some embodiments, the transparent layer 1225 and the window or opening 1230 may be optically aligned with the one or more markers.

Figure 13A:
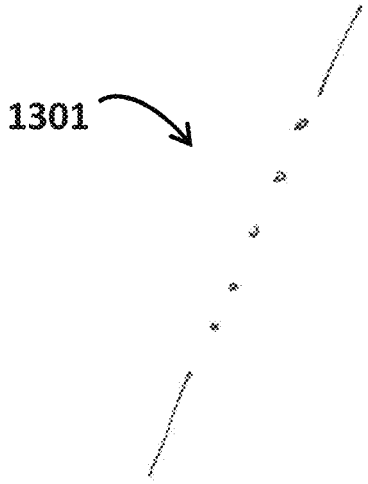
FIGS. 13A-13C schematically illustrate a plurality of markers that can visually indicate a movement or a deformation of the free floating support structures disclosed herein, in accordance with some embodiments.
Figure 13B:
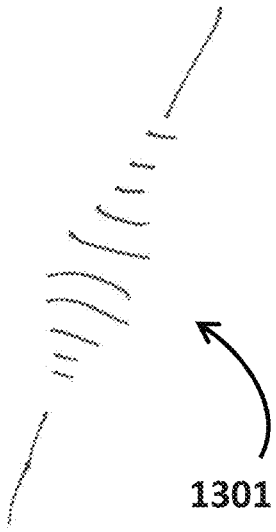
Figure 13C:
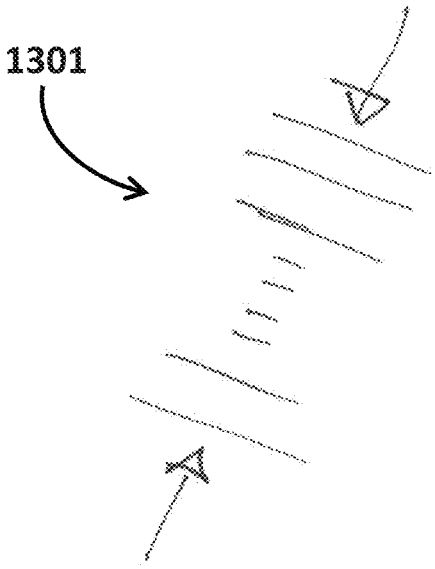

FIGS. 13A-13C show some non-limiting examples of visual markers 1301 that can be provided on or applied to the support structure. In some cases, the visual markers 1301 may include a series of dots or lines that are spaced apart. In some cases, the visual markers 1301 may include a plurality of spaced apart dots or lines that extend across a length or a width of the support structure. In some cases, the visual markers 1301 may include a first set of lines extending across the support structure in a first direction and a second set of lines extending across the support structure in a second direction. In some cases, the visual markers 1301 may include one or more straight lines and/or one or more curved lines.

Flex Characteristics

In some embodiments, the support structures disclosed herein may have a flex characteristic that changes or varies based on a relative orientation of the support structure. The flex characteristic may include, for example, an ability of the support structure to twist, turn, flex, bend, or otherwise deform in response to forces exerted on the shoe during a golf-related action or movement.

In some embodiments, the support structures may have a first orientation (e.g., an upright configuration) that provides a first flex characteristic and a second orientation (e.g., an upside down configuration) that provides a second flex characteristic. In some cases, the first flex characteristic may be different than the second flex characteristic.

In some embodiments, the support structures of the present disclosure may include a first support structure for a first (right/left) shoe and a second support structure for a second (left/right) shoe. In some cases, the first support structure may provide a first flex characteristic when oriented in an upright configuration in the first shoe. In some cases, the second support structure may provide a first flex characteristic when oriented in an upright configuration in the second shoe.

In some embodiments, the first support structure may be integrated with the second shoe instead of the first shoe, and the second support structure may be integrated with the first shoe instead of the second shoe. In some cases, the first support structure may be flipped and oriented in an upside down configuration in the second shoe, and the second support structure may be flipped and oriented in an upside down configuration in the first shoe. In some cases, changing the orientations of the first and second support structures may change a flex characteristic of the support structures. In some embodiments, by swapping the first and second support structures between the first and second shoes and reorienting the support structures, it may be possible to achieve multiple different flex profiles for each shoe using just a single set of support structures.

Support Structure Materials

In some embodiments, the support structure may comprise a rigid or semi-rigid material. In some embodiments, the support structure may comprise a deformable or elastic material. In some embodiments, the support structure may be configured to bend or flex in response to a force exerted on the shoe by a subject (e.g., a golfer) during a golf-related action or movement.

In some embodiments, the support structure may comprise a metallic material. In some cases, the metallic material may include one or more of aluminum, calcium, magnesium, barium, scandium, titanium, vanadium, chromium, manganese, iron, cobalt, nickel, copper, zinc, yttrium, niobium, molybdenum, ruthenium, rhodium, silver, cadmium, actinium, and/or gold.

In some embodiments, the support structure may comprise an intermetallic material. In some cases, the intermetallic material may include, for example, brass (copper and zinc), bronze (copper and tin), duralumin (aluminum, copper, manganese, and/or magnesium), gold alloys (gold and copper), rose-gold alloys (gold, copper, and zinc), nichrome (nickel and chromium), and stainless steel (iron, carbon, and additional elements such as manganese, nickel, chromium, molybdenum, boron, titanium, silicon, vanadium, tungsten, cobalt, and/or niobium). In some cases, the intermetallic material may include superalloys. The superalloys may be based on elements including iron, nickel, cobalt, chromium, tungsten, molybdenum, tantalum, niobium, titanium, and/or aluminum.

In some embodiments, the support structure may comprise a ceramic material. In some cases, the ceramic material may comprise a metal (e.g., aluminum, titanium, etc.), a non-metal (e.g., oxygen, nitrogen, etc.), and/or a metalloid (e.g., germanium, silicon, etc.) having atoms primarily held in ionic and/or covalent bonds. Examples of the ceramic materials may include, for example, an aluminide, boride, beryllia, carbide, chromium oxide, hydroxide, sulfide, nitride, mullite, kyanite, ferrite, titania zirconia, yttria, and/or magnesia.

In some embodiments, the support structure may comprise a composite material. The composite material may include, for example, a carbon-based composite material, a fiberglass-based composite material, a thermoplastic-based composite material, or any other type of composite material that can provide additional structural support and rigidity to the sole assembly of the shoe.

In some embodiments, the support structure may comprise a binding polymer matrix and reinforcing fibers. The binding polymer can include, for example, a thermoset material such as polyester, polyolefin, nylon, or polyurethane. In some cases, the reinforcing fibers may comprise one or more carbon fibers. Other fibers, such as aramids (e.g., Kevlar™), aluminum, or glass fibers can also be used in addition to or in place of the carbon fibers.

In some embodiments, the support structure may comprise a plastic material. In some embodiments, the plastic material may include, for example, thermoplastic polyurethane (TPU), polyethylene terephthalate (PET), polypropylene (PP), polycarbonate (PC), polyvinyl chloride (PVC), and the like.

Additional Notes

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept.

The embodiments illustrated herein are described in sufficient detail to enable those skilled in the art to practice the teachings disclosed. Other embodiments may be used and derived therefrom, such that substitutions and changes may be made without departing from the scope of this disclosure. The disclosure, therefore, is not to be taken in a limiting sense, and the scope of various embodiments includes the full range of equivalents to which the disclosed subject matter is entitled.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. These and other variations, modifications, additions, and improvements fall within the scope of the subject matter herein and as represented by the appended claims. The specification and drawings are, accordingly, to be regarded in an illustrative rather than a restrictive sense.

The above description is intended to be illustrative, and not restrictive. For example, the above-described examples (or one or more aspects thereof) may be used in combination with each other. Other embodiments can be realized, such as by one of ordinary skill in the art, upon reviewing the above description. Also, in the above description, various features may be grouped together to streamline the disclosure. This should not be interpreted as intending that an unclaimed disclosed feature is essential to any claim. Rather, inventive subject matter may lie in less than all features of a particular disclosed embodiment.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and/or "A and B." In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

An Abstract is included to allow the reader to quickly ascertain the nature of the technical disclosure. It is submitted with the understanding that it will not be used to interpret or limit the scope or meaning of the claims.

The scope of the invention may be determined with reference to the appended claims, along with the full scope of any equivalents to which such claims are entitled. The following claims are hereby incorporated into the description as examples or embodiments, with each claim standing on its own as a separate embodiment, and it is contemplated that such embodiments can be combined with each other in various combinations or permutations without departing from the spirit and scope of the invention.

What is claimed is:

1. A golf shoe, comprising:

an upper and a sole assembly connected to the upper, the sole assembly comprising a midsole and an outsole;

a footbed disposed within an interior region of the upper to support a subject's foot when the subject's foot is positioned within the golf shoe, wherein the footbed comprises a channel, a recess, or a groove formed within and extending along a bottom surface of the footbed;

an insole component provided below the footbed; and a support structure comprising (i) a forefoot portion, (ii) a midfoot portion, and (iii) a heel portion that is riveted to the footbed, wherein the forefoot portion is fully detached or decoupled from the footbed, the insole component, and the midsole, wherein the support structure is positioned within the channel, recess, or groove, wherein at least the forefoot portion of the support structure is configured to move laterally through the channel, recess, or groove and flex independently of the footbed, the insole component, and the midsole during a golf-related action or movement.

2. The golf shoe of claim 1, wherein the support structure is riveted to the footbed in a heel portion of the golf shoe.

3. The golf shoe of claim 1, wherein the midfoot portion of the support structure is detached from the footbed.

4. The golf shoe of claim 1, further comprising a foam material provided between the footbed and the support structure.

5. The golf shoe of claim 4, wherein the support structure is riveted to the footbed using a rivet that is configured to extend through the foam material provided between the footbed and the support structure.

6. The golf shoe of claim 4, wherein the foam material is positioned entirely within a heel region of the golf shoe.

7. The golf shoe of claim 1, wherein the support structure has a first orientation that provides a first flex characteristic and a second orientation that provides a second flex characteristic that is different than the first flex characteristic.

8. The golf shoe of claim 1, wherein the support structure is riveted to the footbed at a single attachment point.

9. The golf shoe of claim 1, wherein only the heel portion of the support structure is riveted to the footbed.

10. The golf shoe of claim 1, wherein the midfoot portion of the support structure is detached from the insole component.

11. The golf shoe of claim 1, wherein the support structure is provided above the insole component and within the interior region of the upper.

12. The golf shoe of claim 1, wherein the support structure comprises a rigid material or a semi-rigid material.

13. The golf shoe of claim 1, wherein the support structure comprises a deformable material or an elastic material.

14. The golf shoe of claim 1, further comprising a low friction coating applied to a surface of the support structure.

15. The golf shoe of claim 1, wherein the heel portion of the support structure is detached or decoupled from the insole component.

* * * * *